US011380997B2

(12) United States Patent
Kosaka

(10) Patent No.: US 11,380,997 B2
(45) Date of Patent: Jul. 5, 2022

(54) ANTENNA

(71) Applicant: JAPAN AVIATION ELECTRONICS INDUSTRY, LIMITED, Tokyo (JP)

(72) Inventor: Keishi Kosaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 25 days.

(21) Appl. No.: 17/008,788

(22) Filed: Sep. 1, 2020

(65) Prior Publication Data

US 2021/0126373 A1 Apr. 29, 2021

(30) Foreign Application Priority Data

Oct. 29, 2019 (JP) ..... JP2019-196315

(51) Int. Cl.

| | |
|---|---|
| ***H01Q 9/26*** | (2006.01) |
| ***H01Q 9/04*** | (2006.01) |
| ***H01Q 5/10*** | (2015.01) |
| ***H01Q 7/00*** | (2006.01) |
| ***H01Q 1/36*** | (2006.01) |
| ***H01Q 5/321*** | (2015.01) |

(52) U.S. Cl.

CPC ..... *H01Q 9/265* (2013.01); *H01Q 1/36* (2013.01); *H01Q 5/10* (2015.01); *H01Q 5/321* (2015.01); *H01Q 7/00* (2013.01); *H01Q 9/0407* (2013.01)

(58) Field of Classification Search

CPC ..... H01Q 9/265; H01Q 5/10; H01Q 5/321; H01Q 7/00; H01Q 9/0407; H01Q 1/36; H01Q 9/0485; H01Q 1/46

See application file for complete search history.

(56) References Cited

U.S. PATENT DOCUMENTS

| | | | | |
|---|---|---|---|---|
| 7,113,143 | B2 | 9/2006 | Minemura | |
| 7,518,561 | B2 * | 4/2009 | Mei | H01Q 9/40 343/702 |
| 7,579,992 | B2 * | 8/2009 | Ryou | H01Q 21/30 343/702 |
| 9,496,616 | B2 | 11/2016 | Toyao | |
| 9,502,761 | B2 | 11/2016 | Itoh et al. | |
| 10,218,071 | B2 * | 2/2019 | Toyao | H01Q 13/10 |
| 10,340,609 | B2 | 7/2019 | Kosaka et al. | |
| 10,367,248 | B2 * | 7/2019 | Toyao | H01Q 1/38 |
| 10,374,318 | B2 * | 8/2019 | Moldovan | H01Q 13/16 |
| 10,403,976 | B2 | 9/2019 | Uchida | |

(Continued)

FOREIGN PATENT DOCUMENTS

| | | |
|---|---|---|
| CN | 1266803 C | 7/2006 |
| EP | 3001503 A1 | 3/2016 |

(Continued)

OTHER PUBLICATIONS

U.S. Appl. No. 17/008,776; First Named Inventor: Keishi Kosaka; Title: "Antenna"; filed Sep. 1, 2020.

Korean Office Action (and English language translation thereof) dated Jul. 21, 2021 issued in counterpart Korean Application No. 10-2020-0113802.

(Continued)

*Primary Examiner* — Vibol Tan

(74) *Attorney, Agent, or Firm* — Holtz, Holtz & Volek PC

(57) ABSTRACT

An antenna comprises a split ring resonator. The antenna has a main portion, a feeding portion and at least one radiation element. The main portion forms a split ring. The feeding portion is provided on the main portion. The radiation element extends from the main portion.

7 Claims, 10 Drawing Sheets

(56) References Cited

U.S. PATENT DOCUMENTS

| | | | | |
|---|---|---|---|---|
| 11,101,563 | B2 * | 8/2021 | Hashiguchi | H01Q 1/12 |
| 2006/0279464 | A1 | 12/2006 | Mei | |
| 2007/0236391 | A1 | 10/2007 | Ryou et al. | |
| 2016/0294048 | A1 | 10/2016 | Xu et al. | |
| 2018/0062271 | A1 | 3/2018 | Toyao | |
| 2021/0126367 | A1 * | 4/2021 | Kosaka | H01Q 7/00 |
| 2021/0210831 | A1 * | 7/2021 | Kosaka | H01Q 1/36 |

FOREIGN PATENT DOCUMENTS

| | | | |
|---|---|---|---|
| JP | 2005203854 | A | 7/2005 |
| JP | 2015185910 | A | 10/2015 |
| JP | 2016063449 | A | 4/2016 |
| JP | 6020451 | B2 | 10/2016 |
| JP | 2016225956 | A | 12/2016 |
| JP | 2018174585 | A | 11/2018 |
| JP | 2019050641 | A | 3/2019 |
| KR | 20040053741 | A | 6/2004 |
| KR | 20060029594 | A | 4/2006 |
| KR | 20070113852 | A | 11/2007 |
| KR | 20110010416 | A | 2/2011 |
| WO | 2015029383 | A1 | 3/2015 |
| WO | 2016132712 | A1 | 8/2016 |

OTHER PUBLICATIONS

Taiwanese Office Action (and English translation thereof) dated Jun. 30, 2021 issued in counterpart Taiwanese Application No. 109130910.

Extended European Search Report (EESR) dated Feb. 23, 2021 issued in European Application No. 20193686.1.

Taiwanese Office Action dated Mar. 23, 2021 (and English translation thereof) issued in Taiwanese Application No. 109130910.

European Office Action dated Oct. 15, 2021, issued in counterpart European Application No. 20193677.0.

Extended European Search Report (EESR) dated Feb. 22, 2021 issued in counterpart European Application No. 20193677.0.

Korean Office Action (and English language translation thereof) dated Jul. 21, 2021 issued in Korean Application No. 10-2020-0113662.

Taiwanese Office Action (and English language translation thereof) dated Jul. 8, 2021, issued in counterpart Taiwanese Application No. 109130911.

Related U.S. Appl. No. 17/008,776; First Named Inventor: Keishi Kosaka; Title: "Antenna"; filed Sep. 1, 2020.

Taiwanese Office Action (and English language translation thereof) dated Nov. 29, 2021, issued in counterpart Taiwanese Application No. 109130910.

* cited by examiner

ANTENNA

CROSS REFERENCE TO RELATED APPLICATIONS

This application is based on and claims priority under 35 U.S.C. § 119 to Japanese Patent Application No. JP2019-196315 filed Oct. 29, 2019, the contents of which are incorporated herein in their entirety by reference.

BACKGROUND OF THE INVENTION

This invention relates to an antenna.

JPB6020451 (Patent Document 1) discloses a small wideband antenna 900. As shown in FIG. 20, the antenna 900 of Patent Document 1 has a split ring resonator 910 using a split ring 920 which is a ring-shaped conductor with a split portion 922. Specifically, the antenna 900 of Patent Document 1 has a main portion 930 and a feeding portion 940. The main portion 930 forms the split ring 920. The feeding portion 940 is provided on the main portion 930.

The antenna 900 of Patent Document 1 works at a resonance frequency of the split ring resonator 910. In other words, the antenna 900 of Patent Document 1 can resonate at one operating frequency but cannot function over multiband.

SUMMARY OF THE INVENTION

It is therefore an object of the present invention to provide an antenna having a structure which can resonate at a plurality of operating frequencies.

One aspect of the present invention provides an antenna comprising a split ring resonator. The antenna has a main portion, a feeding portion and at least one radiation element. The main portion forms a split ring. The feeding portion is provided on the main portion. The radiation element extends from the main portion.

The antenna of the present invention has at least one radiation element which extends from the main portion forming the split ring. Accordingly, the antenna of the present invention can resonate at both of operating frequencies of the split ring resonator and the radiation element. In other words, the antenna of the present invention has a structure which can resonate at a plurality of operating frequencies.

An appreciation of the objectives of the present invention and a more complete understanding of its structure may be had by studying the following description of the preferred embodiment and by referring to the accompanying drawings.

In the figure, the modification is schematically depicted.

Figure 7:
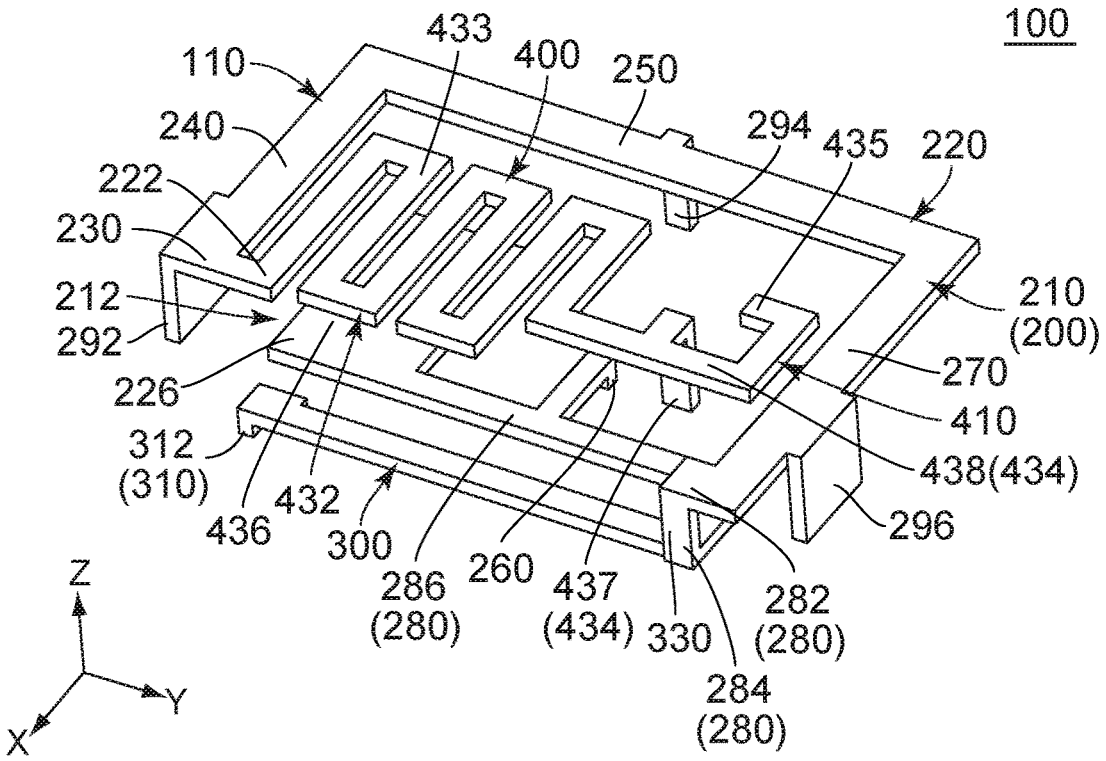
FIG. 7 is an upper, perspective view showing the antenna which is included in the antenna device of FIG. 1.
Figure 18:
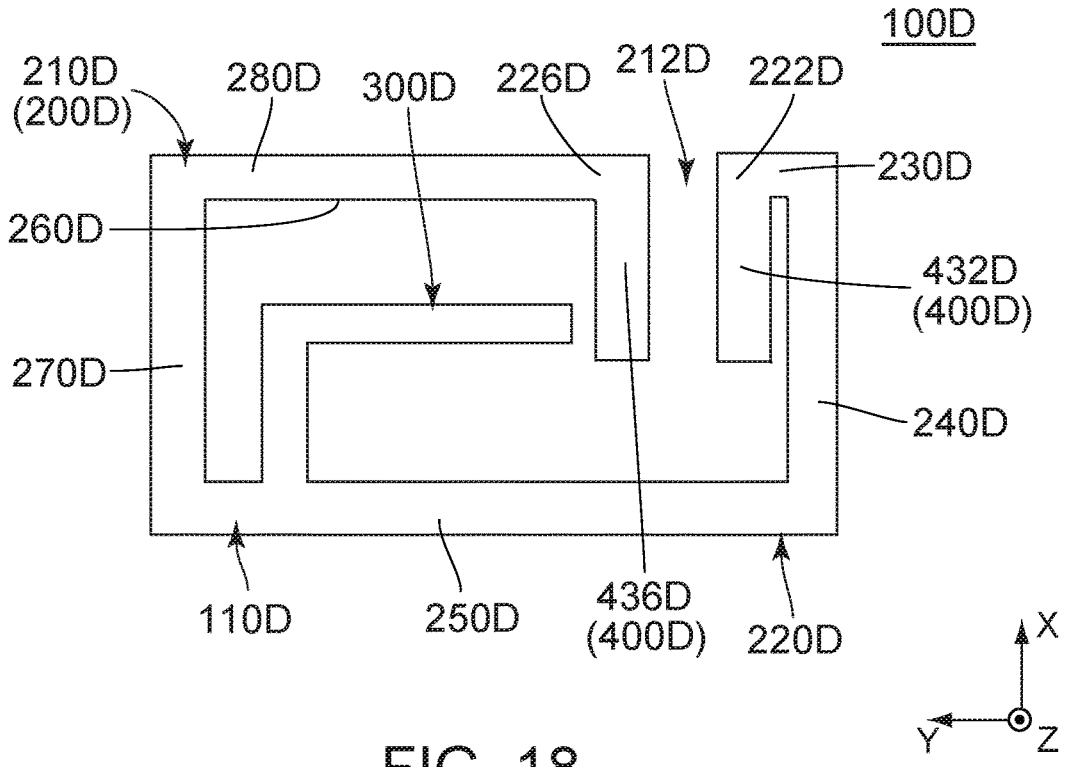

FIG. 18 is a top view showing still another modification of the antenna of FIG. 7. In the figure, the modification is schematically depicted.

Figure 19:
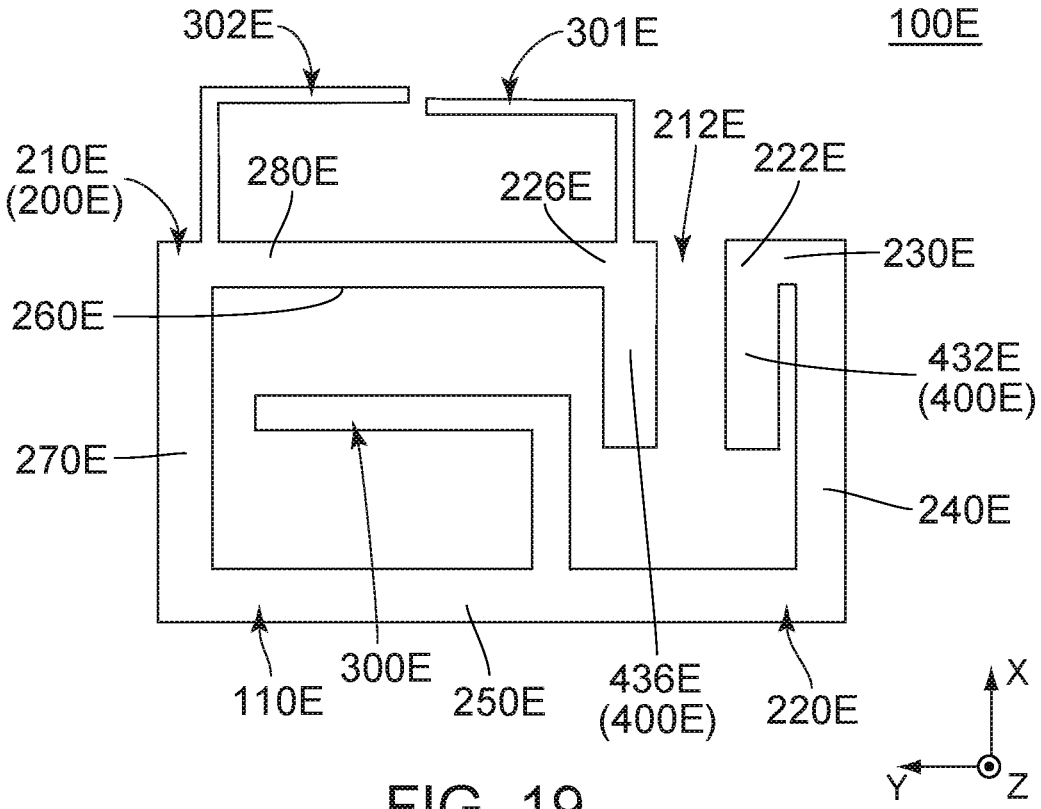

FIG. 19 is a top view showing still yet another modification of the antenna of FIG. 7. In the figure, the modification is schematically depicted.

Figure 20:
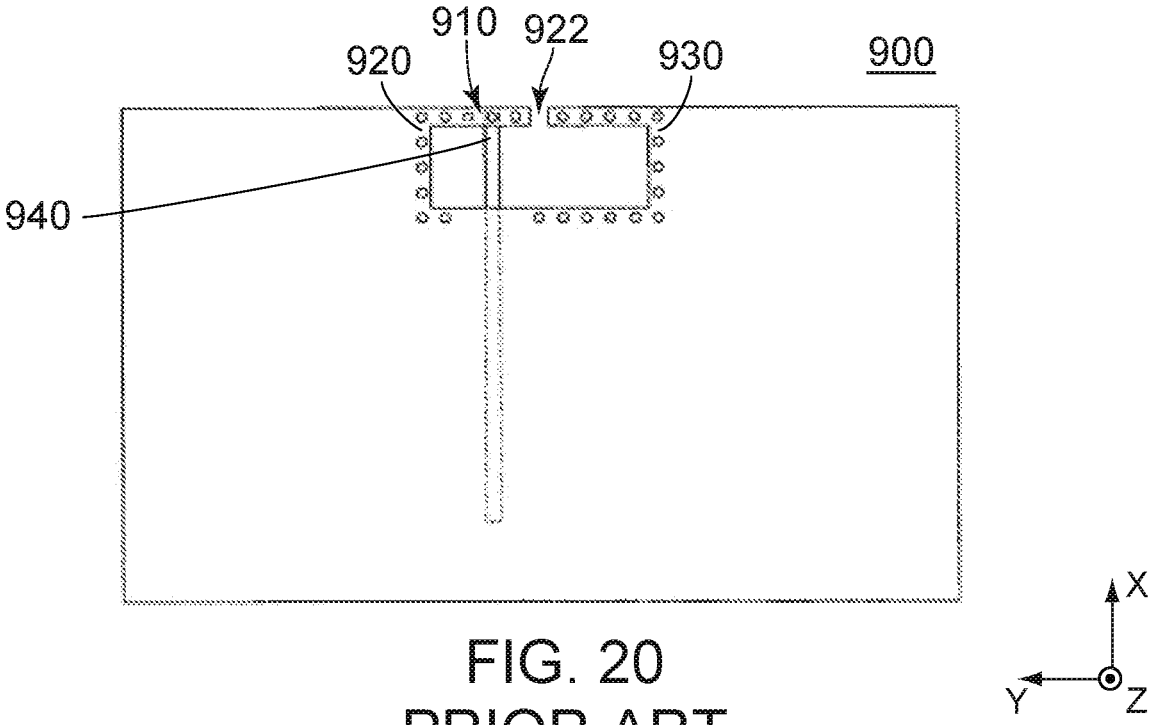
FIG. 20 PRIOR ART

FIG. 20 is a top view showing an antenna of Patent Document 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 1:
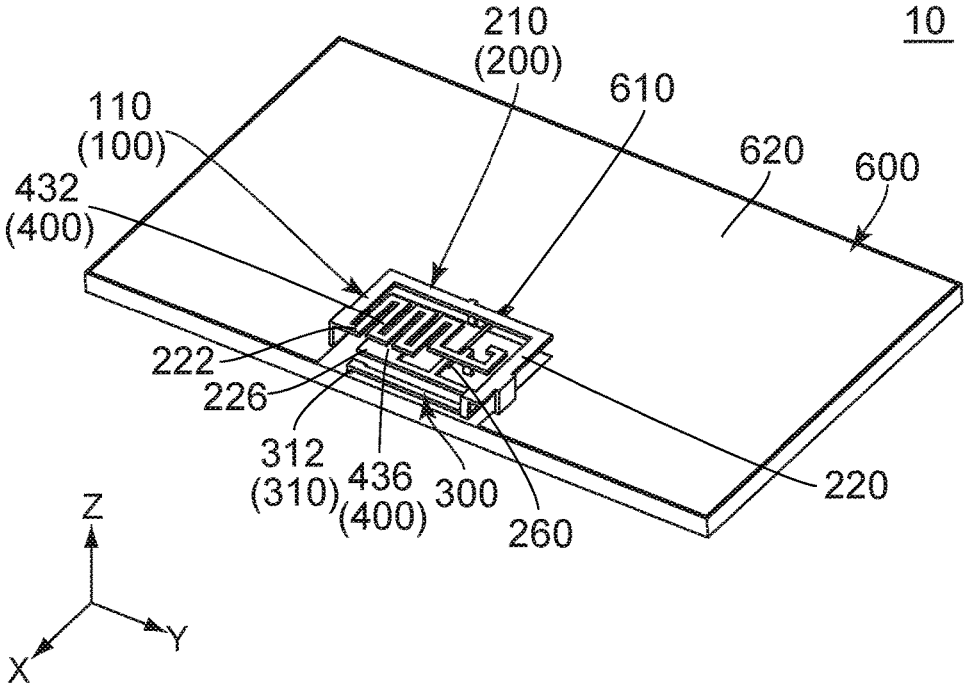
FIG. 1 is a perspective view showing an antenna device according to an embodiment of the present invention. In the figure, an antenna is mounted on a circuit board.

As shown in FIG. 1, an antenna device 10 according to an embodiment of the present invention comprises a circuit board 600 and an antenna 100.

Figure 2:
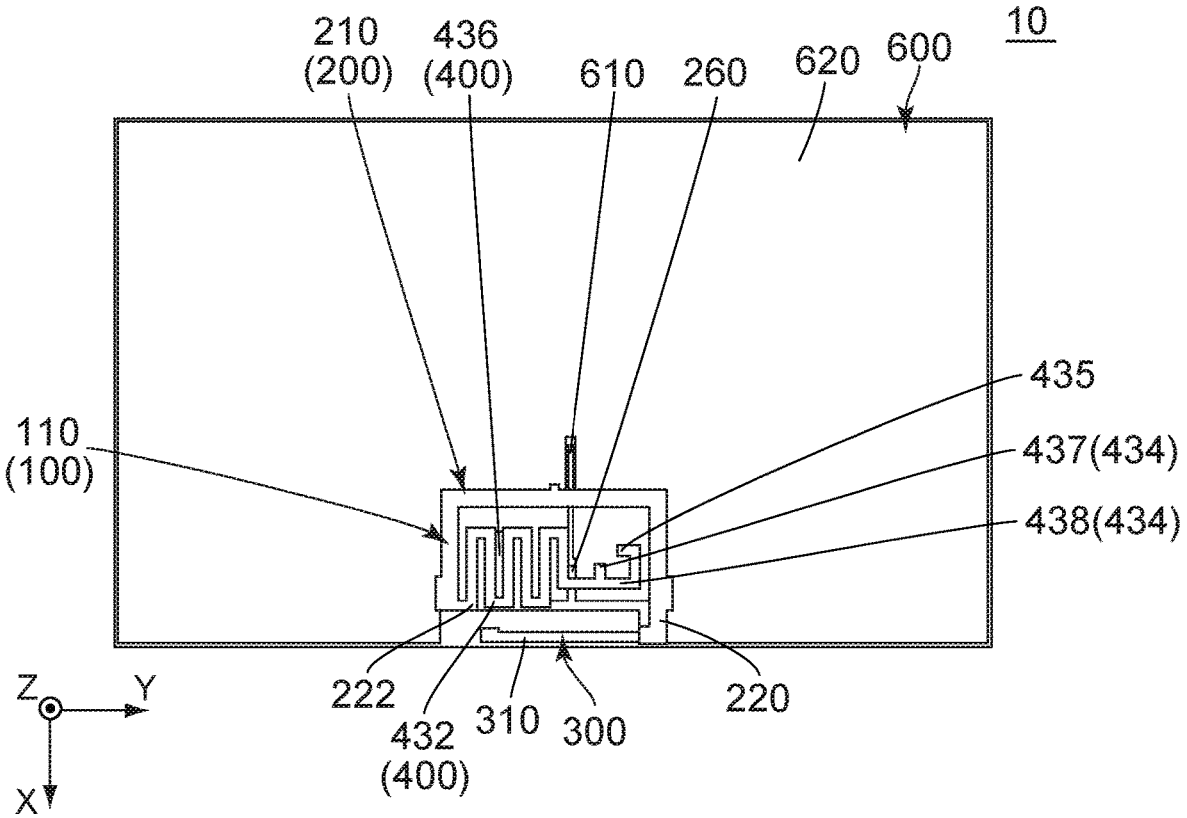
FIG. 2 is a top view showing the antenna device of FIG. 1.

As shown in FIG. 2, the circuit board 600 of the present embodiment is formed with a feeding line 610 and a ground plane 620. Specifically, the feeding line 610 is electrically connected with the antenna 100.

As shown in FIG. 1, the antenna 100 of the present embodiment is formed of metal body 110 which is mounted on the circuit board 600 when used. In other words, the antenna 100 is a discrete member which is mounted on the circuit board 600 when used. However, the present invention is not limited thereto. The antenna 100 of the present invention may be formed of a plurality of conductive layers and vias which are included in a multilayer wiring substrate. Alternatively, the antenna of the present invention may be formed by another method, such as plating metal films on a resin body or sticking metal bodies on a resin body. The antenna 100 has a split ring resonator 200. The antenna 100 has a plurality of operating frequencies. The antenna 100 has a split ring resonator structure which is made of metal plate. In other words, the antenna 100 of the present embodiment is a resonant antenna.

As shown in FIG. 7, the antenna 100 has a main portion 220, a feeding portion 260, a radiation element 300, a first facing portion 432 and a second facing portion 436. The main portion 220 forms a split ring 210. However, the present invention is not limited thereto. The antenna 100 may be modified, provided that the antenna 100 has the main portion 220 forming the split ring 210, the feeding portion 260 and one or more of the radiation elements 300.

Referring FIG. 7, the main portion 220 of the present embodiment constitutes an inductance of the antenna 100. The main portion 220 has a ring shape with a split portion 212. The wording "ring shape" as used herein includes not only a substantially rectangular ring shape as the present embodiment and a circular shape but also an elliptical annular shape and a polygonal annular shape.

As shown in FIG. 7, the main portion 220 has a first portion 230, a second portion 240, a third portion 250, a fourth portion 270, a fifth portion 280, a first end portion 222, a second end portion 226, two grounding portions 292, 296 and a fixed portion 294.

Figure 9:
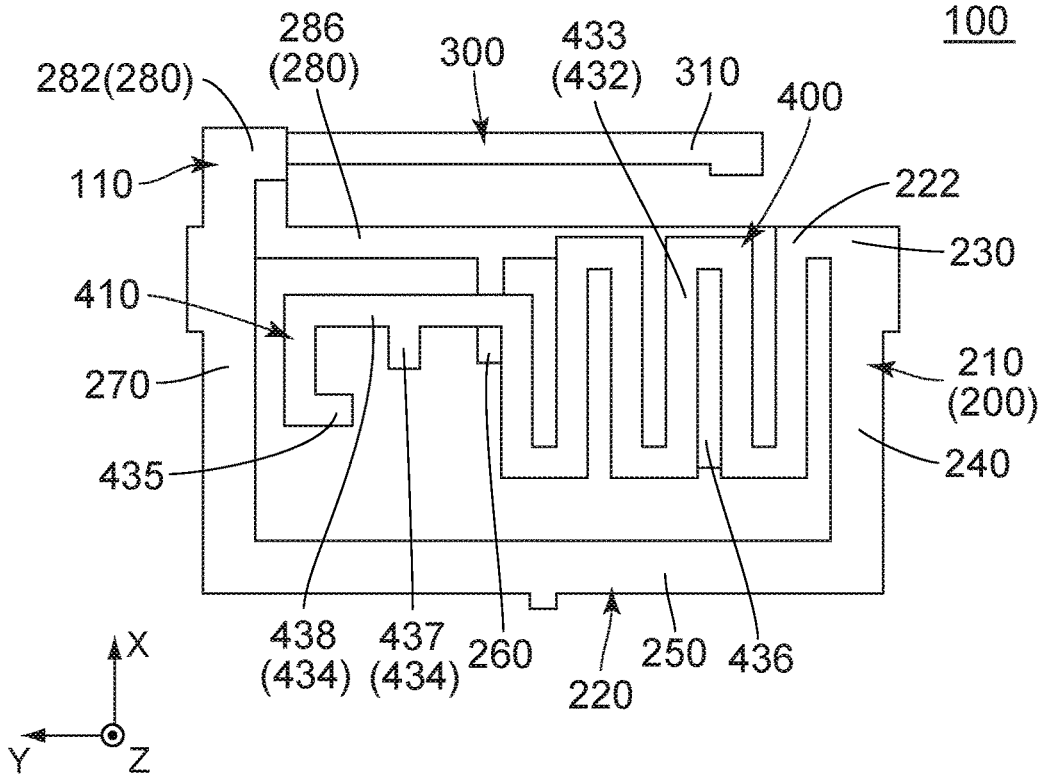
FIG. 9 is a top view showing the antenna of FIG. 7.
Figure 10:
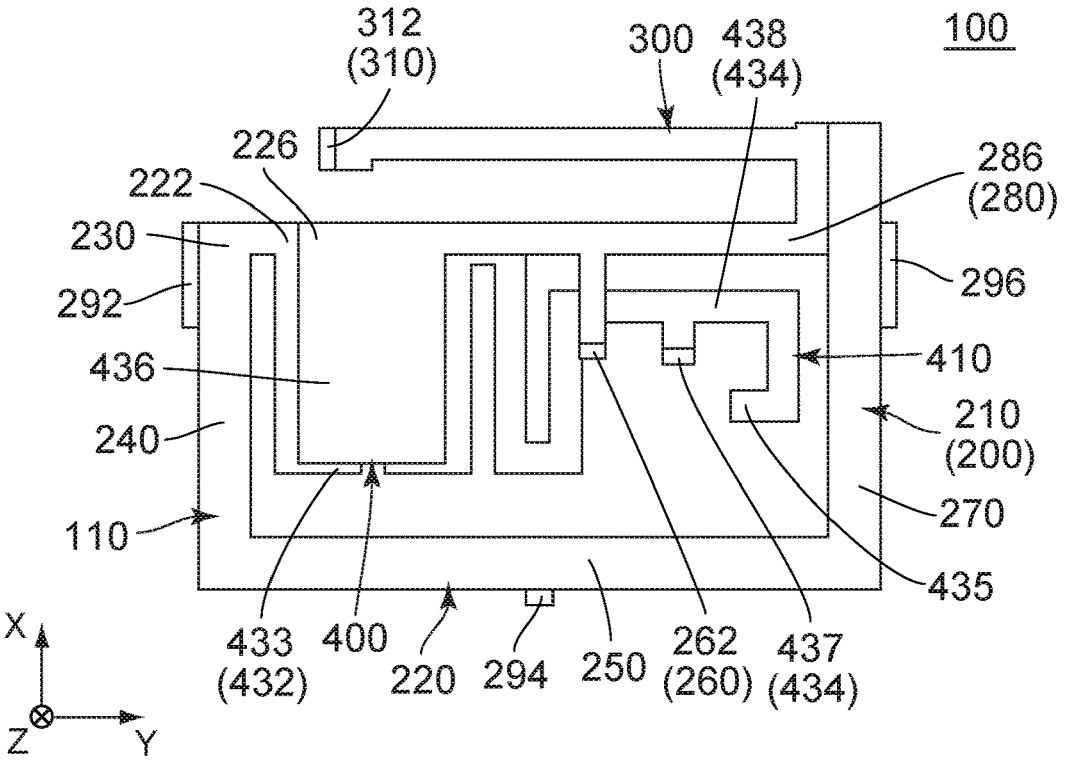
FIG. 10 is a bottom view showing the antenna of FIG. 7.

As shown in FIGS. 9 and 10, the first portion 230 of the present embodiment has a flat-plate shape perpendicular to an up-down direction. In the present embodiment, the up-down direction is a Z-direction. Specifically, upward is a positive Z-direction while downward is a negative Z-direction. The first portion 230 extends in a right-left direction. The first portion 230 defines a right end of the main portion 220 in the right-left direction. In the present embodiment, the right-left direction is a Y-direction. Specifically, rightward is a negative Y-direction while leftward is a positive Y-direction.

As shown in FIGS. 9 and 10, the second portion 240 of the present embodiment has a flat-plate shape perpendicular to the up-down direction. The second portion 240 extends rearward in a front-rear direction from a rear end of the first portion 230. In the present embodiment, the front-rear direction is an X-direction. Specifically, forward is a positive X-direction while rearward is a negative X-direction.

As shown in FIGS. 9 and 10, the third portion 250 of the present embodiment has a flat-plate shape perpendicular to the up-down direction. The third portion 250 extends leftward in the right-left direction from a rear end of the second portion 240. The third portion 250 defines a rear end of the main portion 220 in the front-rear direction. The third portion 250 is positioned rearward of the first portion 230 in the front-rear direction.

As shown in FIGS. 9 and 10, the fourth portion 270 of the present embodiment has a flat-plate shape perpendicular to the up-down direction. The fourth portion 270 extends forward in the front-rear direction from a front end of the third portion 250. The fourth portion 270 defines a left end of the main portion 220 in the right-left direction. The fourth portion 270 is positioned leftward of the second portion 240 in the right-left direction.

Figure 8:
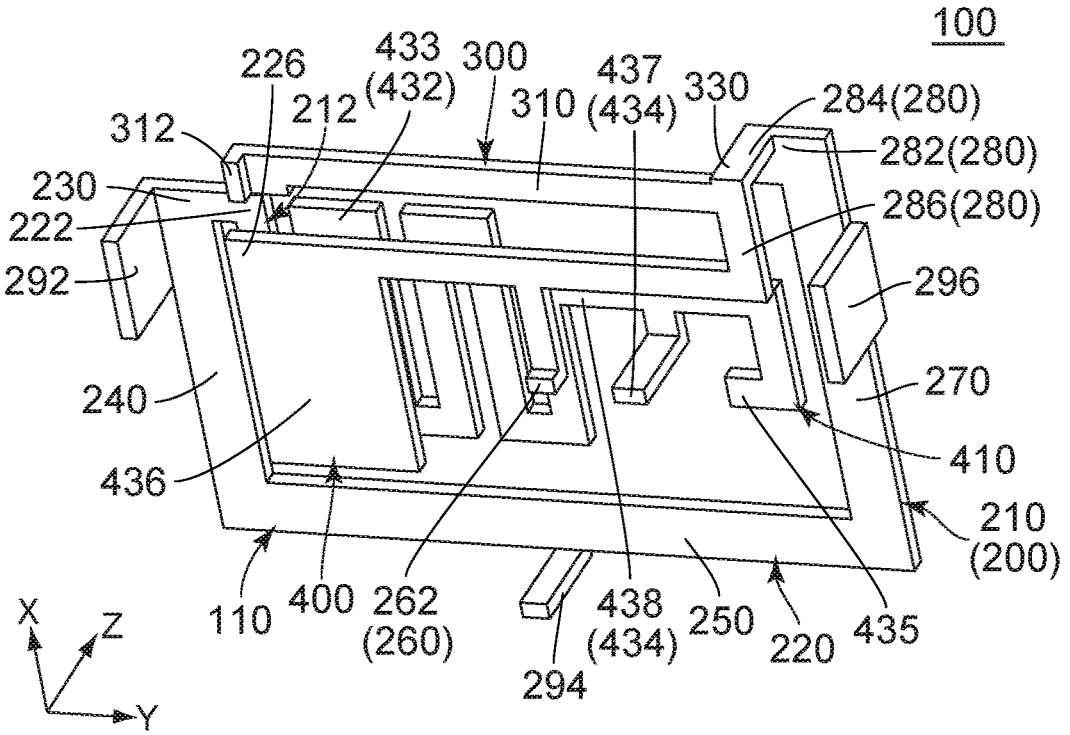
FIG. 8 is a lower, perspective view showing the antenna of FIG. 7.

As shown in FIGS. 7 and 8, the fifth portion 280 of the present embodiment has an upper portion 282, a middle portion 284 and a lower portion 286.

As shown in FIGS. 7 and 8, the upper portion 282 of the present embodiment has a flat-plate shape perpendicular to the up-down direction. The upper portion 282 extends rightward in the right-left direction from a front end of the fourth portion 270. As shown in FIG. 9, the upper portion 282 is positioned forward of the first portion 230 in the front-rear direction.

As shown in FIG. 8, the middle portion 284 of the present embodiment has a flat-plate shape perpendicular to the front-rear direction. The middle portion 284 extends downward in the up-down direction from a lower end of the upper portion 282. The middle portion 284 is positioned forward of the radiation element 300 in the front-rear direction. The middle portion 284 defines a front end of the main portion 220 in the front-rear direction.

As shown in FIG. 8, the lower portion 286 of the present embodiment has a flat-plate shape perpendicular to the up-down direction. The lower portion 286 extends rearward in the front-rear direction from a lower end of the middle portion 284 and then extends rightward in the right-left direction. As shown in FIG. 10, the lower portion 286 has a substantially L-shape when the metal body 110 is viewed from below.

As shown in FIG. 9, the first end portion 222 of the present embodiment is provided on the first portion 230 of the main portion 220. The first end portion 222 is positioned rightward of the radiation element 300 in the right-left direction. The first end portion 222 is positioned rearward of the radiation element 300 in the front-rear direction.

Figure 11:
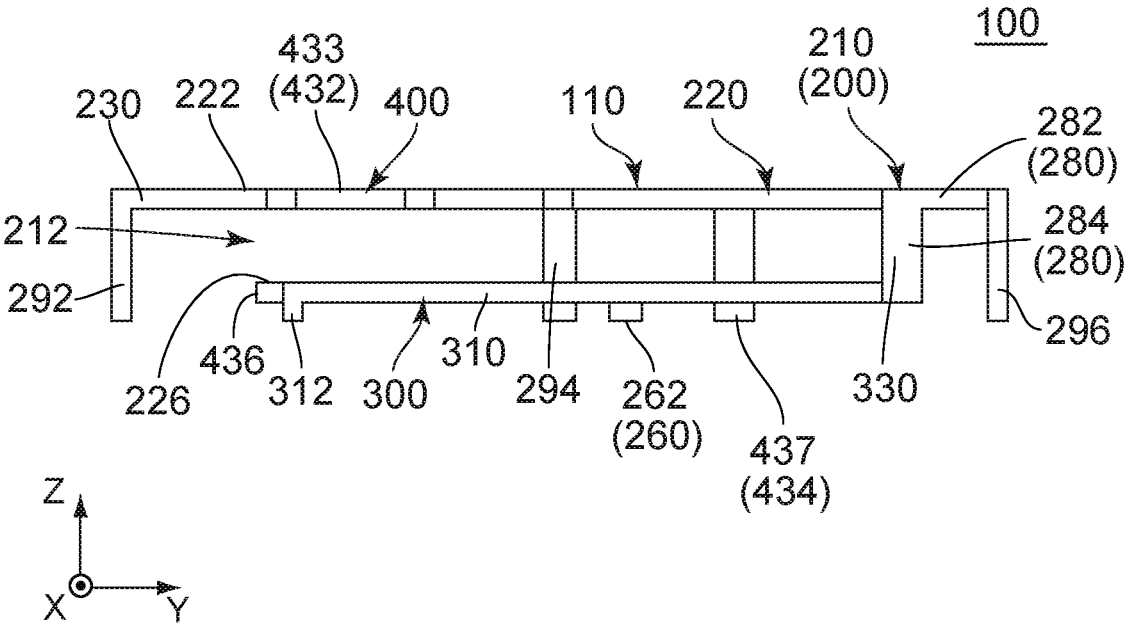
FIG. 11 is a front view showing the antenna of FIG. 7.

As shown in FIG. 10, the second end portion 226 of the present embodiment is provided on the lower portion 286 of the fifth portion 280 of the main portion 220. The second end portion 226 is positioned at a right end of the lower portion 286 of the fifth portion 280 of the main portion 220 in the right-left direction. The second end portion 226 is positioned rearward of the radiation element 300 in the front-rear direction. The second end portion 226 is positioned at a position same as a position of the first end portion 222 in the front-rear direction. As shown in FIG. 11, the second end portion 226 is positioned below the first end portion 222 in the up-down direction.

Referring to FIGS. 7 and 8, the first end portion 222 and the second end portion 226 form the split portion 212 of the split ring 210. In other words, the main portion 220 has the first end portion 222 and the second end portion 226 which form the split portion 212 of the split ring 210.

As shown in FIG. 11, the split portion 212 of the present embodiment is a space which extends in a plane perpendicular to the up-down direction. The split portion 212 is positioned between the first end portion 222 and the second end portion 226 in the up-down direction. The split portion 212 is sandwiched between the first end portion 222 and the second end portion 226 in the up-down direction. In the up-down direction, the split portion 212 is positioned below the first end portion 222 and above the second end portion 226. As shown in FIG. 7, the split portion 212 is positioned between the first facing portion 432 and the second facing portion 436 in the up-down direction. The split portion 212 is sandwiched between the first facing portion 432 and the second facing portion 436 in the up-down direction. In the up-down direction, the split portion 212 is positioned below the first facing portion 432 and above the second facing portion 436. The split portion 212 is positioned between the second portion 240 and the fourth portion 270 in the right-left direction. The split portion 212 is positioned between the second portion 240 and the fifth portion 280 in the right-left direction. As understood from the FIG. 8, the split portion 212 is positioned between the second portion 240 and the lower portion 286 of the fifth portion 280 in the right-left direction. The split portion 212 is positioned below any of the first portion 230, the second portion 240 and the third portion 250 and the fourth portion 270 in the up-down. The split portion 212 is positioned below the upper portion 282 of the fifth portion 280 in the up-down direction. The split portion 212 is positioned above the lower portion 286 of the fifth portion 280 in the up-down direction.

Figure 4:
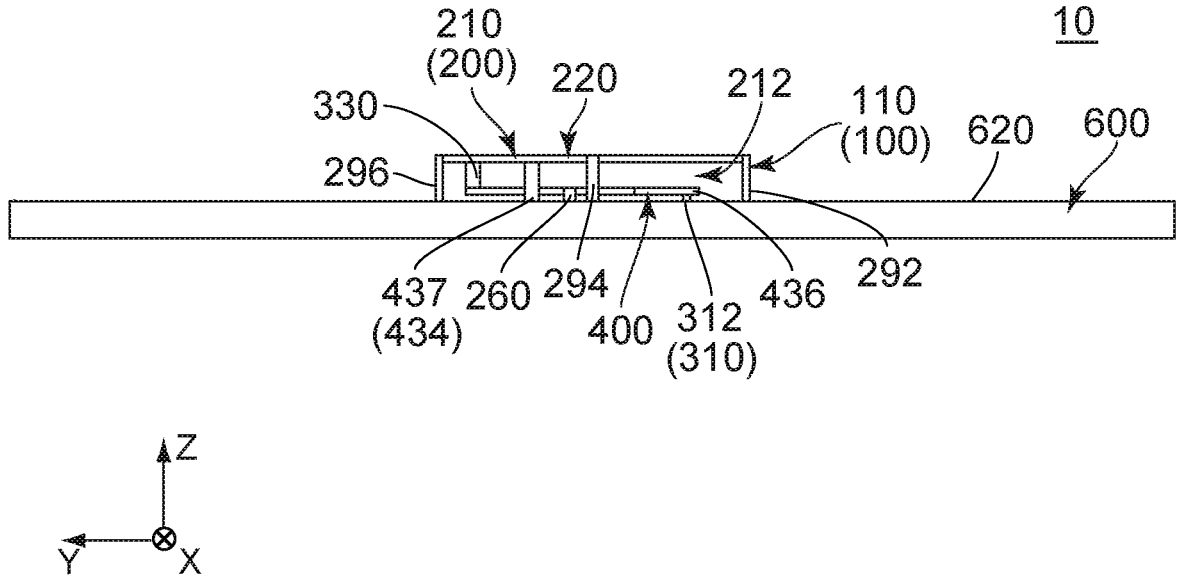
FIG. 4 is a rear view showing the antenna device of FIG. 1.
Figure 5:
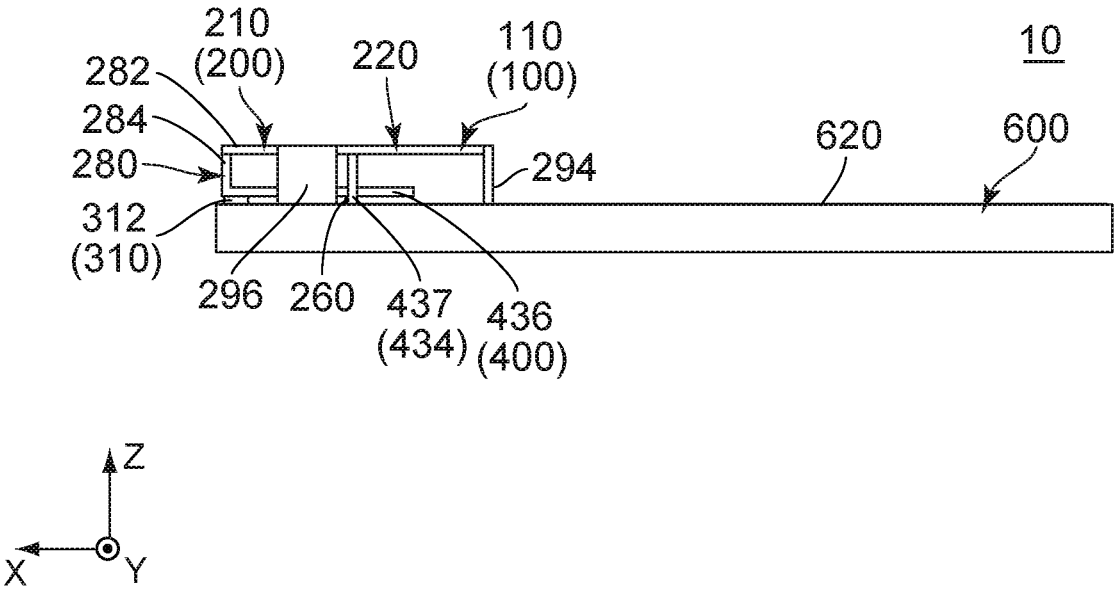
FIG. 5 is a side view showing the antenna device of FIG. 1.
Figure 6:
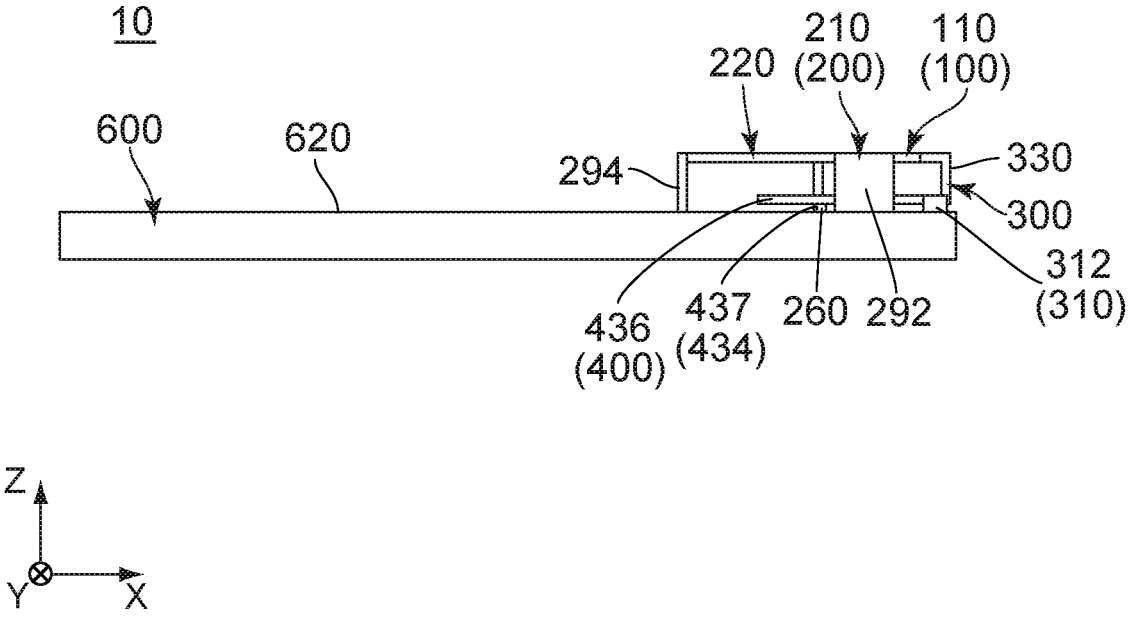
FIG. 6 is another side view showing the antenna device of FIG. 1.

As shown in FIG. 8, the grounding portion 292 of the present embodiment is provided on the first portion 230 of the main portion 220 and the grounding portion 296 of the present embodiment is provided on the fourth portion 270 of the main portion 220. In detail, each of the grounding portions 292, 296 has a rectangular plate-like shape. Each of the grounding portions 292, 926 are positioned at opposite ends, respectively, of the main portion 220 in the right-left direction. The grounding portion 292 is provided at a front end of a side edge of the first portion 230. The grounding portion 296 is provided in the vicinity of a front end of a side edge of the fourth portion 270. The grounding portion 292 extends downward from the first portion 230. The grounding portion 296 extends downward from the fourth portion 270. As shown in FIG. 4, the grounding portions 292, 296 are electrically connected with the ground plane 620 formed on the circuit board 600 when the antenna 100 is mounted on the circuit board 600.

As shown in FIG. 8, the fixed portion 294 of the present embodiment is provided on the third portion 250 of the main portion 220. In detail, the fixed portion 294 extends downward from a middle in the right-left direction of a rear edge of the third portion 250. As shown in FIG. 4, when the antenna 100 is mounted on the circuit board 600, the fixed portion 294 is fixed on the circuit board 600 and supports the main portion 220. The fixed portion 294 may be electrically connected with the ground plane 620 but instead may not be connected with the ground plane 620. Although the number of the fixed portion 294 of the present embodiment is one, the main portion 220 may have two or more of the fixed portions 294.

As shown in FIG. 2, the feeding portion 260 of the present embodiment is electrically connected with the feeding line 610 of the circuit board 600 when the antenna 100 is mounted on the circuit board 600. Here, an electrical connecting method between the feeding portion 260 and the feeding line 610 is not particularly limited. For example, the feeding portion 260 may be directly connected to the feeding line 610 by soldering or the like. Alternatively, the feeding portion 260 may be located near a part of the feeding line 610 with an interval left therebetween to be connected capacitively or electromagnetically. At any rate, the feeding portion 260 and the feeding line 610 should be electrically connected to each other so that the feeding portion 260 is supplied with electric power from the feeding line 610. As shown in FIG. 8, the feeding portion 260 is provided on the main portion 220. More specifically, the feeding portion 260 extends downward from the lower portion 286 of the fifth portion 280 of the main portion 220. The feeding portion 260 is provided with a fixed portion 262 which is configured to be fixed to the feeding line 610 of the circuit board 600 as shown in FIG. 2. The fixed portion 262 of the present embodiment is a lower end of the feeding portion 260.

As shown in FIG. 8, the radiation element 300 of the present embodiment extends from the main portion 220. The radiation element 300 is formed integrally with other parts of the antenna 100. However, the present invention is not limited thereto. The radiation element 300 may be distinct and separated from the other parts of the antenna 100. The radiation element 300 forms a so-called inverted L-shape antenna. An electrical length of the radiation element 300 is defined with reference to one fourth of a wavelength of one of the operating frequencies of the antenna 100. In other words, the radiation element 300 corresponds to one fourth of a wavelength of any one of the operating frequencies of the antenna 100.

As shown in FIG. 8, the radiation element 300 has an extending portion 310 and a coupling portion 330.

As shown in FIG. 8, the extending portion 310 of the present embodiment has a flat-plate shape perpendicular to the up-down direction. As shown in FIG. 9, the extending portion 310 extends in the right-left direction perpendicular to the up-down direction. The extending portion 310 is positioned away from the main portion 220 and extends along the main portion 220. However, the present invention is not limited thereto. The extending portion 310 may be modified, provided that the extending portion 310 is positioned away from the main portion 220 while partially extending along the main portion 220. The extending portion 310 and the lower portion 286 of the fifth portion 280 are positioned on a common plane perpendicular to the up-down direction. The extending portion 310 and a part of the lower portion 286 of the fifth portion 280 are arranged parallel to each other with an interval left therebetween. Thus, the radiation element 300 resonates with the split ring resonator 200 and enhances the function of the antenna 100.

Figure 3:
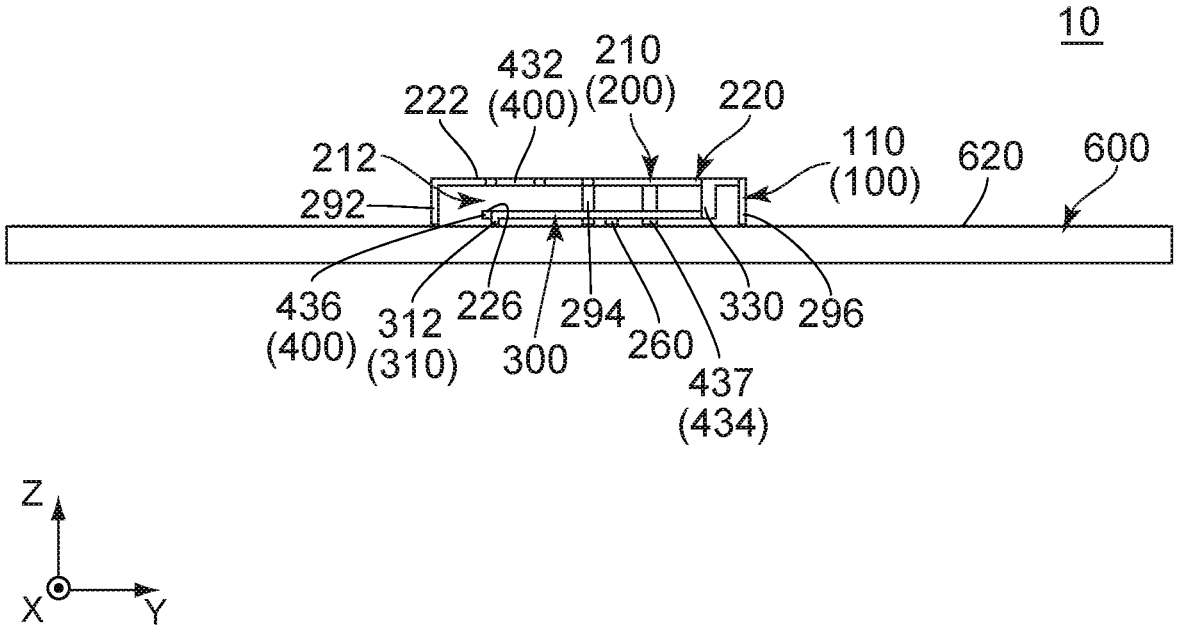
FIG. 3 is a front view showing the antenna device of FIG. 1.

As shown in FIG. 3, the extending portion 310 is provided with a fixed portion 312 which is configured to be fixed on the circuit board 600.

As shown in FIG. 4, the fixed portion 312 of the present embodiment is fixed on the circuit board 600 when the antenna 100 is mounted on the circuit board 600. But, the fixed portion 312 is not connected with a conductive portion which is included in the circuit board 600. In other words, the fixed portion 312 mechanically supports the radiation element 300. The fixed portion 312 extends downward in the up-down direction. The fixed portion 312 is positioned at a right end of the extending portion 310 in the right-left direction. However, the present invention is not limited thereto. An arrangement of the fixed portion 312 may be modified accordingly.

As shown in FIG. 11, the coupling portion 330 of the present embodiment extends in the up-down direction perpendicular to both the front-rear direction and the right-left direction. The coupling portion 330 couples the extending portion 310 and the main portion 220 with each other. More specifically, the coupling portion 330 couples the extending portion 310 and the fifth portion 280 of the main portion 220 with each other. A direction in which the extending portion 310 extends intersects with a direction in which the coupling portion 330 extends. More specifically, the direction in which the extending portion 310 extends is perpendicular to the direction in which the coupling portion 330 extends.

As shown in FIG. 7, the first facing portion 432 of the present embodiment extends from the first end portion 222. However, the present invention is not limited thereto. The first facing portion 432 may be modified, provided that the first facing portion 432 is provided on the first end portion 222 or extends from the first end portion 222. The first facing portion 432 forms an open stub 410 in part. An electrical length of the first facing portion 432 defines an electrical length, or a predetermined electrical length, of the open stub 410. The first facing portion 432 has a meander portion 433 and an extension portion 434.

As shown in FIG. 9, the meander portion 433 of the present embodiment extends leftward in the right-left direction from the first end portion 222. The meander portion 433 has a meandering shape when viewed along the up-down direction. The meander portion 433 is positioned between the first portion 230 and the third portion 250 in the front-rear direction. More specifically, in the front-rear direction, the meander portion 433 is positioned rearward of the first portion 230 and forward of the third portion 250. The meander portion 433 is positioned between the fifth portion 280 and the third portion 250 in the front-rear direction. The meander portion 433 is positioned rearward of the fifth portion 280 in the front-rear direction. The meander portion 433 is positioned between the second portion 240 and the fourth portion 270 in the right-left direction. More specifically, in the right-left direction, the meander portion 433 is positioned leftward of the second portion 240 and rightward of the fourth portion 270. The meander portion 433 is positioned rearward of the radiation element 300 in the front-rear direction. As shown in FIG. 7, the meander portion 433 is positioned above the lower portion 286 of the fifth portion 280 in the up-down direction. The meander portion 433 is positioned above the feeding portion 260 in the up-down direction. The meander portion 433 is positioned above the radiation element 300 in the up-down direction. The meander portion 433 is positioned rightward of the coupling portion 330 of the radiation element 300 in the right-left direction. As shown in FIG. 10, the meander portion 433 is positioned rightward of the feeding portion 260 in the right-left direction.

As shown in FIG. 9, the extension portion 434 of the resent embodiment extends leftward in the right-left direction from the meander portion 433. The extension portion 434 is positioned between the first portion 230 and the third portion 250 in the front-rear direction. More specifically, in the front-rear direction, the extension portion 434 is positioned rearward of the first portion 230 and forward of the third portion 250. The extension portion 434 is positioned between the fifth portion 280 and the third portion 250 in the front-rear direction. The extension portion 434 is positioned rearward of the fifth portion 280 in the front-rear direction. The extension portion 434 is positioned between the second portion 240 and the fourth portion 270 in the right-left direction. More specifically, in the right-left direction, the extension portion 434 is positioned leftward of the second portion 240 and rightward of the fourth portion 270. The extension portion 434 is positioned rearward of the radiation element 300 in the front-rear direction.

As shown in FIG. 9, the main portion 220 is arranged to be partly parallel to the first facing portion 432. More specifically, each of a part of the lower portion 286 of the fifth portion 280, the fourth portion 270 and the third portion 250 of the main portion 220 is arranged to be partly parallel to a part of the extension portion 434 of the first facing portion 432. Thus, the main portion 220 forms the open stub 410 in part.

As shown in FIG. 10, the extension portion 434 of the present embodiment has an extension main portion 438 and a fixed portion 437.

As shown in FIG. 9, the extension main portion 438 of the present embodiment extends leftward from the meander portion 433, and is bent to extend rearward, and is further bent to extends rightward. As shown in FIG. 7, the extension main portion 438 is positioned above the lower portion 286 of the fifth portion 280 in the up-down direction. The extension main portion 438 is positioned above the feeding portion 260 in the up-down direction. The extension main portion 438 is positioned rightward of the coupling portion 330 of the radiation element 300 in the right-left direction. The extension main portion 438 has an end 435.

As shown in FIG. 9, the end 435 of the present embodiment is a free end. Specifically, the end 435 is not short-circuited with the second facing portion 436. The end 435 is positioned between the first portion 230 and the third portion 250 in the front-rear direction. More specifically, in the front-rear direction, the end 435 is positioned rearward of the first portion 230 and forward of the third portion 250. The end 435 is positioned between the fifth portion 280 and the third portion 250 in the front-rear direction. The end 435 is positioned rearward of the fifth portion 280 in the front-rear direction. The end 435 is positioned between the second portion 240 and the fourth portion 270 in the right-left direction. More specifically, in the right-left direction, the end 435 is positioned leftward of the second portion 240 and the rightward of the fourth portion 270. As shown in FIG. 7, the end 435 is positioned above the feeding portion 260 in the up-down direction. The end 435 is positioned rightward of the coupling portion 330 of the radiation element 300 in the right-left direction. As shown in FIG. 10, the end 435 is positioned rearward of the feeding portion 260 in the front-rear direction. The end 435 is positioned leftward of the feeding portion 260 in the right-left direction. The end 435 is positioned rearward of the radiation element 300 in the front-rear direction.

As understood from FIGS. 7 and 9, the first portion 230, the second portion 240, the third portion 250, the fourth portion 270, the upper portion 282 of the fifth portion 280, the meander portion 433 of the first facing portion 432 and the extension main portion 438 of the first facing portion 432 are positioned on a common plane perpendicular to the up-down direction.

As shown in FIG. 4, the fixed portion 437 of the present embodiment is fixed on the circuit board 600 when the antenna 100 is mounted on the circuit board 600. The fixed portion 437 prevents a deformation of the first facing portion 432. The fixed portion 437 is not connected with the conductive portion which is included in the circuit board 600 having the ground plane 620. As shown in FIG. 8, the fixed portion 437 extends rearward from the extension main portion 438 and then extends downward. As shown in FIG. 9, the fixed portion 437 is positioned between the radiation element 300 and the third portion 250 in the front-rear direction. The fixed portion 437 is positioned between the first portion 230 and the third portion 250 in the front-rear direction. The fixed portion 437 is positioned between the second portion 240 and the fourth portion 270 in the right-left direction. The fixed portion 437 is positioned between the meander portion 433 and the end 435 in the right-left direction. The fixed portion 437 is positioned between the first portion 230 and the end 435 in the front-rear direction. As shown in FIG. 10, the fixed portion 437 is positioned between the feeding portion 260 and the fourth portion 270 in the right-left direction. The fixed portion 437 is positioned between the feeding portion 260 and the end 435 in the right-left direction. However, the present invention is not limited thereto. An arrangement of the fixed portion 437 may be modified accordingly.

Figure 12:
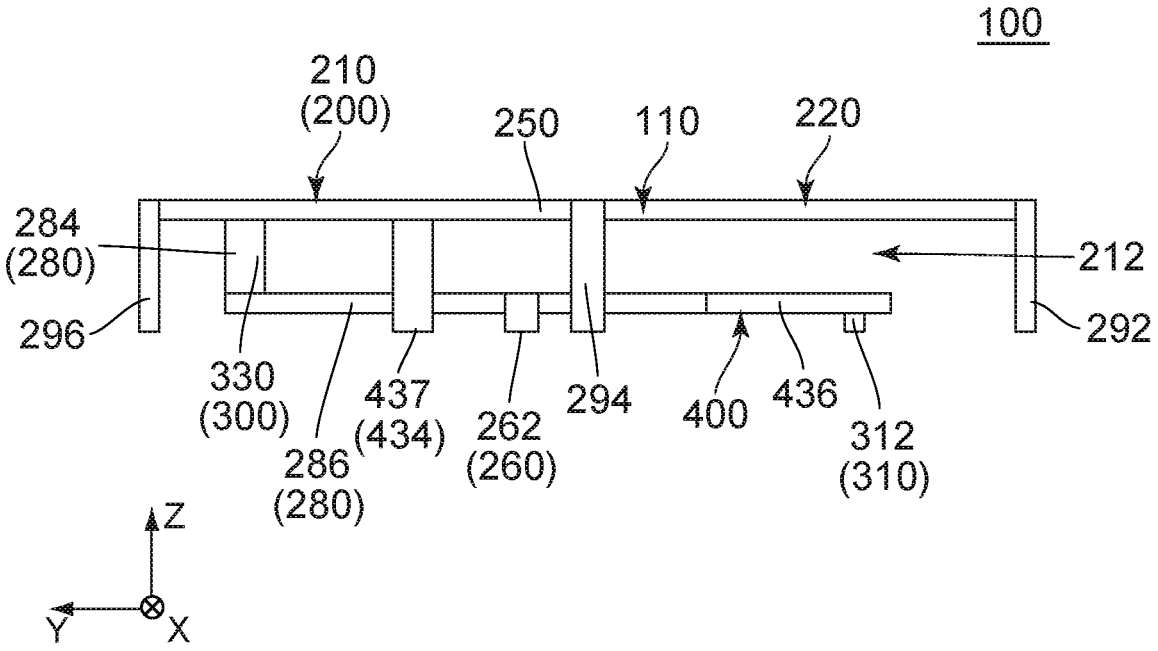
FIG. 12 is a rear view showing the antenna of FIG. 7.
Figure 13:
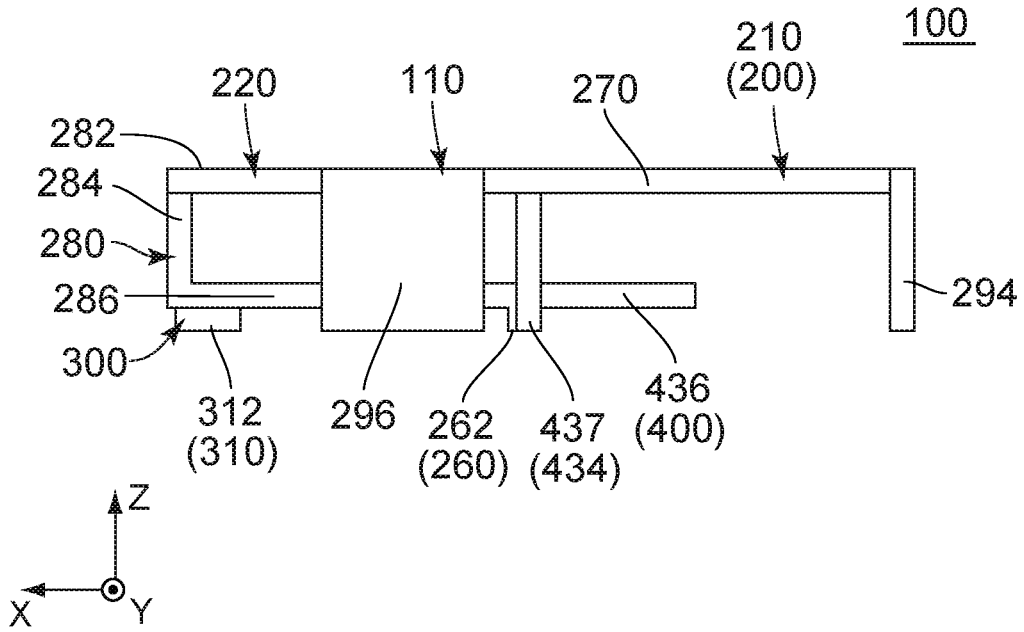
FIG. 13 is a side view showing the antenna of FIG. 7.
Figure 14:
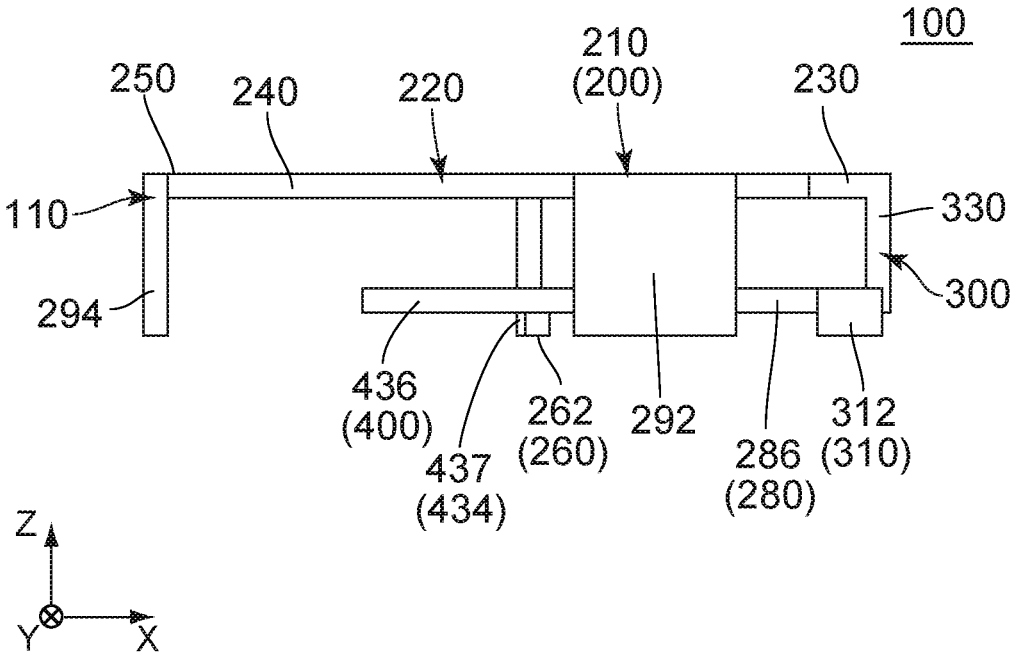
FIG. 14 is another side view showing the antenna of FIG. 7.

As shown in FIGS. 11 and 12, lower ends of the grounding portions 292, 296, a lower end of the fixed portion 294, the fixed portion 262 of the feeding portion 260 and a lower end of the fixed portion 437 of the extension portion 434 are positioned at positions same as each other in the up-down direction.

As shown in FIG. 8, the second facing portion 436 of the present embodiment has a flat-plate shape perpendicular to the up-down direction. The second facing portion 436 extends from the second end portion 226. However, the present invention is not limited thereto. The second facing portion 436 may be modified, provided that the second facing portion 436 is provided on the second end portion 226 or extends from the second end portion 226. As shown in FIG. 11, the first facing portion 432 and the second facing portion 436 are spaced away from each other and face each other. More specifically, in the up-down direction, the first facing portion 432 and the second facing portion 436 are spaced away from each other and face each other. The second facing portion 436 is positioned below the first facing portion 432 in the up-down direction. As understood from FIGS. 9 and 10, the first facing portion 432 and the second facing portion 436 partly overlap with each other when the antenna 100 is viewed along the up-down direction. More specifically, the second facing portion 436 partly overlaps with the meander portion 433 of the first facing portion 432 when the antenna 100 is viewed along the up-down direction. The second facing portion 436 forms the open stub 410 in part.

As shown in FIG. 12, the lower portion 286 of the fifth portion 280 and the second facing portion 436 are positioned on a common plane perpendicular to the up-down direction.

The first facing portion 432, the second facing portion 436, the main portion 220 and the radiation element 300 of the present embodiment are formed from a single metal plate and are integrally formed with each other. However, the present invention is not limited thereto. The antenna 100 may be formed from a plurality of conductive members.

As shown in FIG. 8, the second facing portion 436 is provided with no fixed portion. The second facing portion 436 may, however, be provided with one of more fixed portions as with the first facing portion 432. The fixed portion, which is provided to the second facing portion 436, should not be connected with the conductive portion included in the circuit board 600.

Referring to FIGS. 7 and 8, the first facing portion 432 and the second facing portion 436 of the present embodiment constitute a capacitor 400. Since the main portion 220 constitutes the inductance of the antenna 100 as described above, the first facing portion 432, the second facing portion 436 and the main portion 220 form an LC resonator circuit. An operating frequency of the LC resonator circuit is different from an operating frequency of the radiation element 300.

Referring to FIGS. 7 and 8, the first facing portion 432 and the second facing portion 436 form the open stub 410. More specifically, the first facing portion 432 and the second facing portion 436 form the open stub 410 in part. The first facing portion 432 and the second facing portion 436 form the open stub 410 at not only their parts identical with each other when seen along the up-down direction but also other parts of them. In other words, the first facing portion 432 and the second facing portion 436 form the stub by arranging them near each other. As described above, the main portion 220 forms the open stub 410 in part. Thus, in the antenna 100 of the present embodiment, the open stub 410 is formed by using not only the first facing portion 432 and the second facing portion 436 but also a part of the main portion 220. However, the present embodiment is not limited thereto. The antenna 100 may have a short stub which is formed by short-circuiting the end 435 of the first facing portion 432 and the second facing portion 436 to each other. In other words, the first facing portion 432 and the second facing portion 436 may form the open stub 410 or short stub. In the case of the open stub, the electrical length of the open stub 410, or the predetermined electrical length, must be equal to or longer than a half of a wavelength corresponding to one of the operating frequencies, wherein the half of the wavelength is 0.5λ. On the other hand, in the case of the short stub, an electrical length of the short stub, or a predetermined electrical length, must be equal to or longer than three fourths of a wavelength corresponding to one of the operating frequencies, wherein the three fourths of the wavelength is 0.75λ. Since any of the open stub 410 and the short stub has the predetermined electrical length as described above, the antenna 100 can have the plurality of operating frequencies.

As described above, the antenna 100 of the present embodiment has the single radiation element 300 extending from the main portion 220 which forms the split ring 210. Thus, the antenna 100 can resonate at both of the operating frequencies of the split ring resonator 200 and the radiation element 300. In other words, the antenna 100 of the present embodiment has a structure which can resonate at the plurality of operating frequencies.

More specifically, the antenna 100 of the present embodiment has the structure which can resonate at three operating frequencies, namely, the operating frequency of the LC resonator circuit which is formed by the first facing portion 432, the second facing portion 436 and the main portion 220, an operating frequency corresponding to the electrical length, or the predetermined electrical length, of the open stub 410 and the operating frequency of the radiation element 300.

Where the present embodiment of the present invention is described above, the present embodiment may be modified as follows.

First Modification

Figure 15:
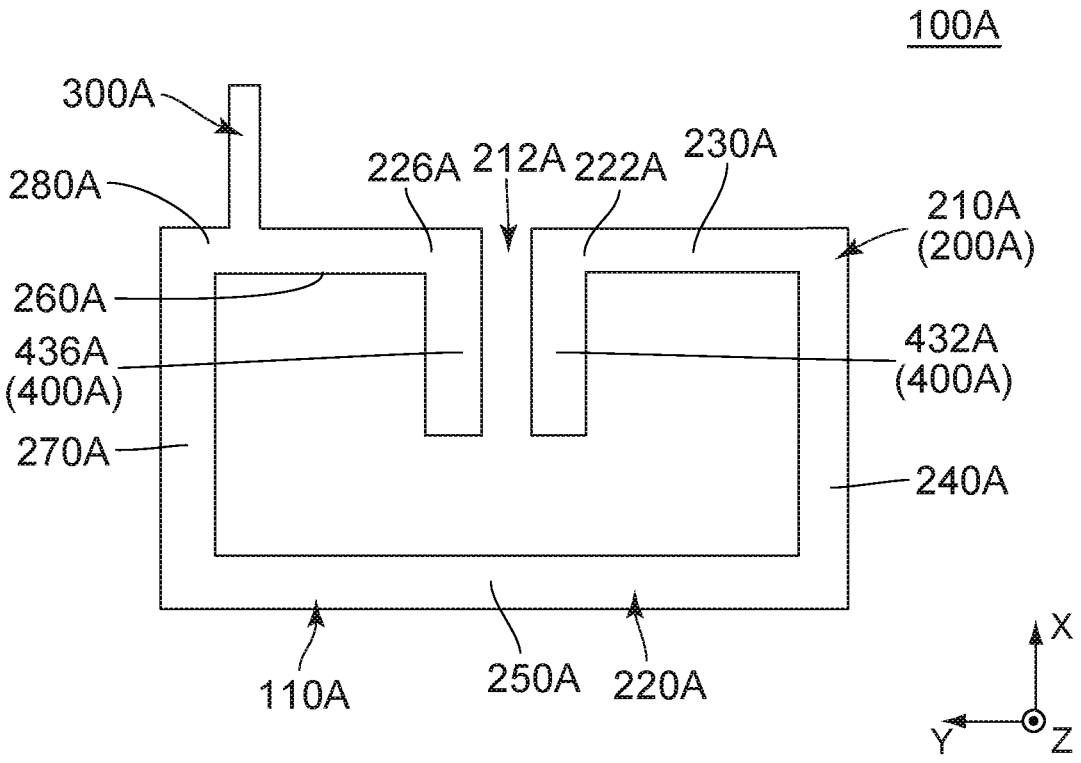
FIG. 15 is a top view showing a modification of the antenna of FIG. 7. In the figure, the modification is schematically depicted.

As shown in FIG. 15, an antenna 100A of a first modification is formed of metal body 110A which is mounted on a circuit board (not shown) when used. However, the present invention is not limited thereto. The antenna 100A may be formed of traces which are printed on a circuit board.

As shown in FIG. 15, the antenna 100A of the present modification has a split ring resonator 200A. The antenna 100A has a plurality of operating frequencies. The antenna 100A has a split ring resonator structure. In other words, the antenna 100A is a resonant antenna.

As shown in FIG. 15, the antenna 100A of the present modification has a main portion 220A, a feeding portion 260A, a radiation element 300A, a first facing portion 432A and a second facing portion 436A. The main portion 220A forms a split ring 210A.

Referring FIG. 15, the main portion 220A of the present modification constitutes an inductance of the antenna 100A. As shown in FIG. 15, the main portion 220A has a ring shape with a split portion 212A. More specifically, the main portion 220A has a substantially rectangular ring shape with four sides. The wording "ring shape" as used herein includes not only a substantially rectangular ring shape as the present modification and a circular shape but also an elliptical annular shape and a polygonal annular shape.

As shown in FIG. 15, the main portion 220A of the present modification has a first portion 230A, a second portion 240A, a third portion 250A, a fourth portion 270A, a fifth portion 280A, a first end portion 222A and a second end portion 226A.

As shown in FIG. 15, the first portion 230A of the present modification extends in the right-left direction. The first portion 230A defines a front end of the main portion 220A in the front-rear direction.

As shown in FIG. 15, the second portion 240A of the present modification extends rearward in the front-rear direction from a rear end of the first portion 230A. The second portion 240A defines a right end of the main portion 220A in the right-left direction.

As shown in FIG. 15, the third portion 250A of the present modification extends leftward in the right-left direction from a rear end of the second portion 240A. The third portion 250A defines a rear end of the main portion 220A in the front-rear direction. The third portion 250A is positioned rearward of the first portion 230A in the front-rear direction.

As shown in FIG. 15, the fourth portion 270A of the present modification extends forward in the front-rear direction from a front end of the third portion 250A. The fourth portion 270A defines a left end of the main portion 220A in the right-left direction. The fourth portion 270A is positioned leftward of the second portion 240A in the right-left direction.

Referring to FIG. 15, any part of the second portion 240A, the third portion 250A and the fourth portion 270A functions as a ground connecting point to be electrically connected with a ground plane (not shown) of the circuit board.

As shown in FIG. 15, the fifth portion 280A of the present modification extends rightward in the right-left direction from a front end of the fourth portion 270A. The fifth portion 280A defines the front end of the main portion 220A.

As shown in FIG. 15, the first end portion 222A of the present modification is provided on the first portion 230A of the main portion 220A.

As shown in FIG. 15, the second end portion 226A of the present modification is provided on the fifth portion 280A of the main portion 220A.

As shown in FIG. 15, the first end portion 222A and the second end portion 226A form the split portion 212A of the split ring 210A. In other words, the main portion 220A has the first end portion 222A and the second end portion 226A which form the split portion 212A of the split ring 210A.

As shown in FIG. 15, the split portion 212A of the present modification is a space which extends in the front-rear direction. The split portion 212A is positioned between the first end portion 222A and the second end portion 226A in the right-left direction. The split portion 212A is sandwiched between the first end portion 222A and the second end portion 226A in the right-left direction. The split portion 212A is positioned between the first facing portion 432A and the second facing portion 436A in the right-left direction. The split portion 212A is sandwiched between the first facing portion 432A and the second facing portion 436A in the right-left direction.

As shown in FIG. 15, the feeding portion 260A is provided on the fifth portion 280A of the main portion 220A.

As shown in FIG. 15, the radiation element 300A of the present modification extends from the main portion 220A. In detail, dissimilar to the radiation element 300 of the aforementioned embodiment, the radiation element 300A extends forward from the fifth portion 280A of the main portion 220A. The radiation element 300A and the main portion 220A are positioned on a common plane perpendicular to the up-down direction. The radiation element 300A corresponds to one fourth of a wavelength of any one of the operating frequencies of the antenna 100A.

As shown in FIG. 15, the first facing portion 432A of the present modification is provided on the first end portion 222A. The first facing portion 432A extends rearward in the front-rear direction from the first end portion 222A.

As shown in FIG. 15, the second facing portion 436A of the present modification is provided on the second end portion 226A. The second facing portion 436A extends rearward in the front-rear direction from the second end portion 226A. The first facing portion 432A and the second facing portion 436A are spaced away from each other and face each other. More specifically, in the right-left direction, the first facing portion 432A and the second facing portion 436A are spaced away from each other and face each other.

Dissimilar to the split ring 210 of the aforementioned embodiment, the split ring 210A of the present modification is configured so that the main portion 220A extends in a plane perpendicular to the up-down direction. Specifically, the first portion 230A, the second portion 240A, the third portion 250A, the fourth portion 270A, the fifth portion 280A, the split portion 212A, the first end portion 222A and the second end portion 226A, which are components of the main portion 220A, are positioned on the common plane perpendicular to the up-down direction. The main portion 220A, the first facing portion 432A and the second facing portion 436A are positioned on the common plane perpendicular to the up-down direction.

Referring to FIG. 15, the first facing portion 432A and the second facing portion 436A of the present modification constitute a capacitor 400A. Since the main portion 220A constitutes the inductance of the antenna 100A as described above, the first facing portion 432A, the second facing portion 436A and the main portion 220A form an LC resonator circuit. An operating frequency of the LC resonator circuit is different from an operating frequency of the radiation element 300A.

As described above, the antenna 100A of the present modification has the single radiation element 300A extending from the main portion 220A which forms the split ring 210A. Thus, the antenna 100A of the present embodiment can resonate at both of the operating frequencies of the split ring resonator 200A and the radiation element 300A. In other words, the antenna 100A of the present modification has a structure which can resonate at the plurality of operating frequencies.

Second Modification

Figure 16:
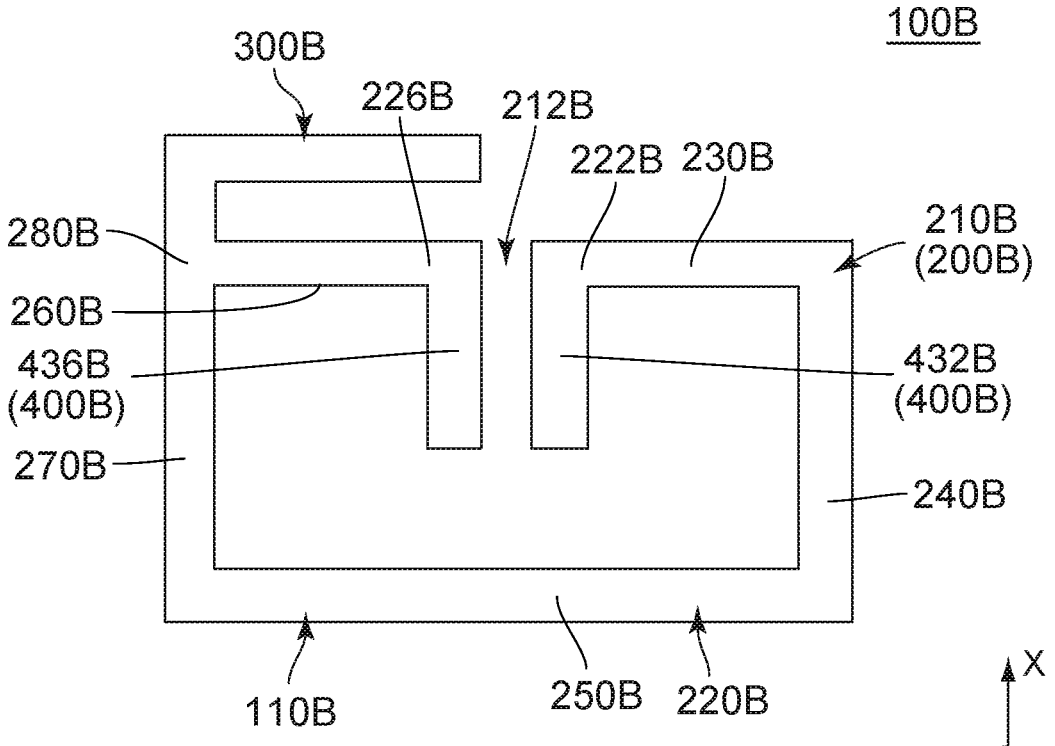
FIG. 16 is a top view showing another modification of the antenna of FIG. 7. In the figure, the modification is schematically depicted.

As shown in FIG. 16, an antenna 100B of a second modification is formed of metal body 110B which is mounted on a circuit board (not shown) when used. However, the present invention is not limited thereto. The antenna 100B may be formed from traces which are printed on a circuit board.

As shown in FIG. 16, the antenna 100B of the present modification has a split ring resonator 200B. The antenna 100B has a plurality of operating frequencies. The antenna 100B has a split ring resonator structure. In other words, the antenna 100B is a resonant antenna.

As shown in FIG. 16, the antenna 100B of the present modification has a main portion 220B, a feeding portion 260B, a radiation element 300B, a first facing portion 432B and a second facing portion 436B. The main portion 220B forms a split ring 210B. The main portion 220B constitutes an inductance of the antenna 100B. The main portion 220B has a first portion 230B, a second portion 240B, a third portion 250B, a fourth portion 270B, a fifth portion 280B, a first end portion 222B and a second end portion 226B. Any part of the second portion 240B, the third portion 250B and the fourth portion 270B functions as a ground connecting point to be electrically connected with a ground plane (not shown) of the circuit board. The first end portion 222B and the second end portion 226B form a split portion 212B of the split ring 210B. Components of the antenna 100B other than the radiation element 300B have structures same as those of the first modification. Accordingly, detailed explanation thereabout is omitted.

As shown in FIG. 16, the radiation element 300B of the present modification extends from the main portion 220B. Specifically, dissimilar to the radiation element 300A of the first modification, the radiation element 300B extends forward from the fifth portion 280B, which is provided with the feeding portion 260B, and is then bent to extend rightward. However, the present invention is not limited thereto. The radiation element 300B may be modified as follows: the radiation element 300B extends forward from the fifth portion 280B, which is provided with the feeding portion 260B, and is then bent to extend leftward. However, the antenna 100B with the original radiation element 300B can, as a whole, have a reduced size as compared with an antenna 100B with the modified radiation element 300B. Thus, the original radiation element 300B is preferred. The radiation element 300B and the main portion 220B are positioned on a common plane perpendicular to the up-down direction. The radiation element 300B corresponds to one fourth of a wavelength of any one of the operating frequencies of the antenna 100B.

Referring to FIG. 16, the first facing portion 432B and the second facing portion 436B of the present modification constitute a capacitor 400B. Since the main portion 220B constitutes the inductance of the antenna 100B as described above, the first facing portion 432B, the second facing portion 436B and the main portion 220B form an LC resonator circuit. An operating frequency of the LC resonator circuit is different from an operating frequency of the radiation element 300B.

As described above, the antenna 100B of the present modification has the single radiation element 300B extending from the main portion 220B which forms the split ring 210B. Thus, the antenna 100B of the present modification can resonate at both of the operating frequencies of the split ring resonator 200B and the radiation element 300B. In other words, the antenna 100B of the present modification has a structure which can resonate at the plurality of operating frequencies.

Third Modification

Figure 17:
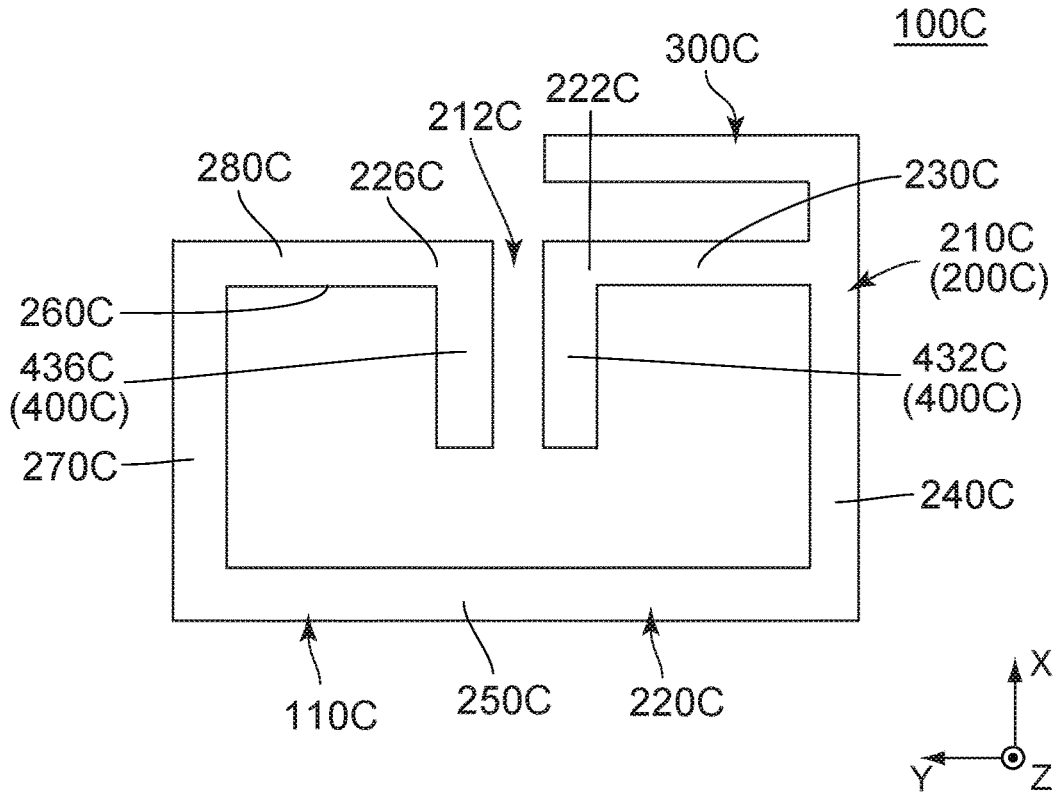
FIG. 17 is a top view showing yet another modification of the antenna of FIG. 7.

As shown in FIG. 17, an antenna 100C of a third modification is formed of metal body 110C which is mounted on a circuit board (not shown) when used. However, the present invention is not limited thereto. The antenna 100C may be formed of traces which are printed on a circuit board.

As shown in FIG. 17, the antenna 100C of the present modification has a split ring resonator 200C. The antenna 100C has a plurality of operating frequencies. The antenna 100C has a split ring resonator structure. In other words, the antenna 100C is a resonant antenna.

As shown in FIG. 17, the antenna 100C of the present modification has a main portion 220C, a feeding portion 260C, a radiation element 300C, a first facing portion 432C and a second facing portion 436C. The main portion 220C forms a split ring 210C. The main portion 220C constitutes an inductance of the antenna 100C. The main portion 220C has a first portion 230C, a second portion 240C, a third portion 250C, a fourth portion 270C, a fifth portion 280C, a first end portion 222C and a second end portion 226C. Any part of the second portion 240C, the third portion 250C and the fourth portion 270C functions as a ground connecting point to be electrically connected with a ground plane (not shown) of the circuit board. The first end portion 222C and the second end portion 226C form a split portion 212C of the split ring 210C. Components of the antenna 100C other than the radiation element 300C have structures same as those of the first modification. Accordingly, detailed explanation thereabout is omitted.

As shown in FIG. 17, the radiation element 300C of the present modification extends from the main portion 220C. In detail, dissimilar to the radiation element 300A of the first modification, the radiation element 300C extends forward from the first portion 230C, which is not provided with the feeding portion 260C, and is then bent to extend leftward. As understood from comparison of the present modification and the second modification, a position at which the radiation element 300C is provided on the main portion 220C does not depend on a position of the feeding portion 260C. The radiation element 300C and the main portion 220C are positioned on a common plane perpendicular to the up-down direction. The radiation element 300C corresponds to one fourth of a wavelength of any one of the operating frequencies of the antenna 100C.

Referring to FIG. 17, the first facing portion 432C and the second facing portion 436C of the present modification constitute a capacitor 400C. Since the main portion 220C constitutes the inductance of the antenna 100C as described above, the first facing portion 432C, the second facing portion 436C and the main portion 220C form an LC resonator circuit. An operating frequency of the LC resonator circuit is different from an operating frequency of the radiation element 300C.

As described above, the antenna 100C of the present modification has the single radiation element 300C extending from the main portion 220C which forms the split ring 210C. Thus, the antenna 100C of the present modification can resonate at both of the operating frequencies of the split ring resonator 200C and the radiation element 300C. In other words, the antenna 100C of the present modification has a structure which can resonate at the plurality of operating frequencies.

Fourth Modification

As shown in FIG. 18, an antenna 100D of a fourth modification is formed of metal body 110D which is mounted on a circuit board (not shown) when used. However, the present invention is not limited thereto. The antenna 100D may be formed of traces which are printed on a circuit board.

As shown in FIG. 18, the antenna 100D of the present modification has a split ring resonator 200D. The antenna 100D has a plurality of operating frequencies. The antenna 100D has a split ring resonator structure. In other words, the antenna 100D is a resonant antenna.

As shown in FIG. 18, the antenna 100D of the present modification has a main portion 220D, a feeding portion 260D, a radiation element 300D, a first facing portion 432D and a second facing portion 436D. The main portion 220D forms a split ring 210D. The main portion 220D constitutes an inductance of the antenna 100D. The main portion 220D has a first portion 230D, a second portion 240D, a third portion 250D, a fourth portion 270D, a fifth portion 280D, a first end portion 222D and a second end portion 226D. Any part of the second portion 240D, the third portion 250D and the fourth portion 270D functions as a ground connecting point to be electrically connected with a ground plane (not shown) of the circuit board. The first end portion 222D and the second end portion 226D form a split portion 212D of the split ring 210D. Components of the antenna 100D other than the radiation element 300D have structures similar to those of the first modification. Accordingly, detailed explanation thereabout is omitted.

As shown in FIG. 18, the radiation element 300D of the present modification extends from the main portion 220D. Specifically, dissimilar to the radiation element 300A of the first modification, the radiation element 300D of the present modification extends forward from the third portion 250D of the main portion 220D and is then bent to extend rightward. The radiation element 300D and the main portion 220D are positioned on a common plane perpendicular to the up-down direction. The radiation element 300D corresponds to one fourth of a wavelength of any one of the operating frequencies of the antenna 100D.

Referring to FIG. 18, the first facing portion 432D and the second facing portion 436D of the present modification constitute a capacitor 400D. Since the main portion 220D constitutes the inductance of the antenna 100D as described above, the first facing portion 432D, the second facing portion 436D and the main portion 220D form an LC resonator circuit. An operating frequency of the LC resonator circuit is different from an operating frequency of the radiation element 300D.

As described above, the antenna 100D of the present modification has the single radiation element 300D extending from the main portion 220D which forms the split ring 210D. Thus, the antenna 100D of the present modification can resonate at both of the operating frequencies of the split ring resonator 200D and the radiation element 300D. In other words, the antenna 100D of the present modification has a structure which can resonate at the plurality of operating frequencies.

Fifth Embodiment

As shown in FIG. 19, an antenna 100E of a fifth modification is formed of metal body 110E which is mounted on a circuit board (not shown) when used. However, the present invention is not limited thereto. The antenna 100E may be formed of traces which are printed on a circuit board.

As shown in FIG. 19, the antenna 100E of the present modification has a split ring resonator 200E. The antenna 100E has a plurality of operating frequencies. The antenna 100E has a split ring resonator structure. In other words, the antenna 100E is a resonant antenna.

As shown in FIG. 19, the antenna 100E of the present modification has a main portion 220E, a feeding portion 260E, three radiation elements 300E, 301E and 302E, a first facing portion 432E and a second facing portion 436E. The main portion 220E forms a split ring 210E. The main portion 220E constitutes an inductance of the antenna 100E. The main portion 220E has a first portion 230E, a second portion 240E, a third portion 250E, a fourth portion 270E, a fifth portion 280E, a first end portion 222E, and a second end portion 226E. Any part of the second portion 240E, the third portion 250E and the fourth portion 270E functions as a ground connecting point to be electrically connected with a ground plane (not shown) of the circuit board. The first end portion 222E and the second end portion 226E form a split portion 212E of the split ring 210E. Components of the antenna 100E other than the radiation elements 300E, 301E and 302E have structures same as those of the fourth modification. Accordingly, detailed explanation thereabout is omitted.

As shown in FIG. 19, each of the radiation elements 300E, 301E and 302E of the present modification extends from the main portion 220E. Specifically, dissimilar to the radiation element 300D of the fourth modification, the radiation element 300E of the present modification extends forward from the third portion 250E of the main portion 220E and is then bent to extend leftward. The radiation element 301E extends forward from around a right end of the fifth portion 280E of the main portion 220E and is then bent to extend leftward. The radiation element 302E extends forward from around a left end of the fifth portion 280E of the main portion 220E and is then bent to extend rightward. The radiation elements 300E, 301E and 302E and the main portion 220E are positioned on a common plane perpendicular to the up-down direction. Each of the radiation elements 300E, 301E and 302E corresponds to one fourth of a wavelength of any one of the operating frequencies of the antenna 100E.

Referring to FIG. 19, the first facing portion 432E and the second facing portion 436E of the present modification constitute a capacitor 400E. Since the main portion 220E constitutes the inductance of the antenna 100E as described above, the first facing portion 432E, the second facing portion 436E and the main portion 220E form an LC resonator circuit. An operating frequency of the LC resonator circuit is different from any of operating frequencies of the radiation elements 300E, 301E and 302E.

As described above, the antenna 100E of the present modification has the three radiation elements 300E, 301 and 302E each extending from the main portion 220E which forms the split ring 210E. Thus, the antenna 100E of the present modification can resonate at any of the operating frequencies of the split ring resonator 200E and the radiation elements 300A, 301E and 302E. In other words, the antenna 100E of the present modification has a structure which can resonate at the plurality of operating frequencies. In particular, the number of the radiation elements 300E, 301E and 302E of the antenna 100E of the present modification is greater than that of the antenna 100A, 100B, 100C and 100D of the aforementioned first to fourth modifications. Accordingly, the number of the operating frequencies of the antenna 100E can be increased with an increased number of the radiation elements.

Although the specific explanation about the present invention is made above referring to the embodiments, the present invention is not limited thereto and is susceptible to various modifications and alternative forms.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An antenna comprising a split ring resonator, wherein:
the antenna has a main portion, a feeding portion, and at least one radiation element;
the main portion forms a split ring;
the feeding portion is provided on the main portion; and
the radiation element extends from the main portion,
wherein:
the main portion has a first end portion and a second end portion,
the split ring has a split portion,
the first end portion and the second end portion form the split portion,
the antenna further has a first facing portion and a second facing portion,
the first facing portion is provided on the first end portion or extends from the first end portion,
the second facing portion is provided on the second end portion or extends from the second end portion, and
the first facing portion and the second facing portion are spaced away from each other and face each other.

2. The antenna recited in claim 1, wherein the first facing portion and the second facing portion constitute a capacitor.

3. The antenna recited in claim 1, wherein the first facing portion and the second facing portion form an open stub or short stub.

4. The antenna recited in claim 1, wherein:

the antenna has a plurality of operating frequencies; and an electrical length of the radiation element corresponds to one fourth of a wavelength of any one of the operating frequencies.

5. The antenna recited in claim 1, wherein:

the radiation element has an extending portion and a coupling portion;

the extending portion is positioned away from the main portion and partially extends along the main portion; and the coupling portion couples the extending portion and the main portion with each other.

6. The antenna recited in claim 5, wherein:

the antenna is formed of metal body which is mountable on a circuit board; and each of the feeding portion and the extending portion is provided with a fixed portion which is configured to be fixed on the circuit board.

7. The antenna recited in claim 5, wherein:

the extending portion extends in a first direction;

the coupling portion extends in a second direction; and the first direction intersects with the second direction.

* * * * *